US011180900B2

(12) United States Patent
Watanabe

(10) Patent No.: US 11,180,900 B2
(45) Date of Patent: Nov. 23, 2021

(54) CONSTRUCTION MACHINE

(71) Applicant: Hitachi Construction Machinery Co., Ltd., Tokyo (JP)

(72) Inventor: Daisuke Watanabe, Ryugasaki (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 657 days.

(21) Appl. No.: 16/081,744

(22) PCT Filed: Mar. 31, 2017

(86) PCT No.: PCT/JP2017/013733

§ 371 (c)(1),
(2) Date: Aug. 31, 2018

(87) PCT Pub. No.: WO2018/179385

PCT Pub. Date: Oct. 4, 2018

(65) Prior Publication Data

US 2021/0207343 A1 Jul. 8, 2021

(51) Int. Cl.

| | |
|---|---|
| ***E02F 9/20*** | (2006.01) |
| ***G05G 1/44*** | (2008.04) |
| *E02F 9/22* | (2006.01) |

(52) U.S. Cl.

CPC ..... *E02F 9/2012* (2013.01); *G05G 1/44* (2013.01); *E02F 9/2267* (2013.01); *E02F 9/2285* (2013.01)

(58) Field of Classification Search

CPC ..... G05G 1/44

See application file for complete search history.

(56) References Cited

U.S. PATENT DOCUMENTS

| | | | | |
|---|---|---|---|---|
| 5,566,716 | A | 10/1996 | Togashi et al. | |
| 7,032,471 | B2 * | 4/2006 | Weber | B66F 9/20 74/469 |
| 2010/0274436 | A1 * | 10/2010 | Kodaka | E02F 9/2004 701/31.4 |

FOREIGN PATENT DOCUMENTS

| | | | |
|---|---|---|---|
| JP | 11-336129 | A | 12/1999 |
| JP | 2007-2893 | A | 1/2007 |
| JP | 2007002893 | A * | 1/2007 |
| JP | 2007-186897 | A | 7/2007 |
| JP | 2008-21218 | A | 1/2008 |

OTHER PUBLICATIONS

Translate2007002893.*

(Continued)

*Primary Examiner* — Vicky A Johnson

(74) *Attorney, Agent, or Firm* — Crowell & Moring LLP

(57) ABSTRACT

A pedal operation switching mechanism can switch a foot pedal to any movement pattern of three movement patterns of a front/rear step pattern of being capable of the operation of depressing a front side of the foot pedal from a neutral position of a rotational part of a pilot valve and of being capable of the operation of depressing a rear side of the foot pedal from the neutral position of the rotational part, a front step limit pattern of being capable of the operation of depressing only the front side of the foot pedal from the neutral position of the rotational part, and a fixing pattern of fixing the movement of the foot pedal in the neutral position of the rotational part.

5 Claims, 11 Drawing Sheets

(56) References Cited

OTHER PUBLICATIONS

International Search Report (PCT/ISA/210 & PCT/ISA/220) issued in PCT Application No. PCT/JP2017/013733 dated May 30, 2017 (five (5) pages).
Japanese-language Written Opinion (PCT/ISA/237) issued in PCT Application No. PCT/JP2017/013733 dated May 30, 2017 (five (5) pages).

* cited by examiner

CONSTRUCTION MACHINE

TECHNICAL FIELD

The present invention relates to construction machines such as hydraulic excavators and the like that are provided with a foot pedal to be foot-operated by an operator.

BACKGROUND ART

In general, a hydraulic excavator that is a representative example of construction machines is provided with an automotive lower traveling structure, an upper revolving structure that is mounted on the lower traveling structure to be capable of revolving thereon, and a front device that is provided in a front side of the upper revolving structure to be capable of tilting and lifting thereto.

The upper revolving structure has a revolving frame that is formed as a support structural body. A cab in which an operator gets is provided in a left front side of the revolving frame. An operator's seat positioned above a floor member is provided within the cab. In addition, a front side of the floor member is configured as a footrest part on which an operator seated on the operator's seat puts his or her foot, and a traveling pedal device for operating the lower traveling structure is provided in a front side position of the footrest part together with a lever.

In general, the front device in the hydraulic excavator is equipped with a bucket for performing an excavating work of earth and sand as a working tool. However, the hydraulic excavator is used for a demolition work of buildings as well in addition to the excavating work of earth and sand. In this case, the front device is equipped with, instead of the bucket, a cutter for cutting steel frames, a grapple for transporting steel frames and concrete pieces, and a breaker for breaking walls and concrete pieces (hereinafter, the cutter, the grapple and the breaker are called as additional working tools).

Accordingly, the footrest part of the floor member is provided with an additional pedal device positioned lateral to the traveling pedal device for operating the additional working tools. The additional pedal device has a valve case provided to bore through the floor member, and includes a pilot valve having a rotational part to be rotated in an upper-lower direction on an upper side section of the valve case projecting from the footrest part, and a foot pedal disposed on the rotational part of the pilot valve to extend in a front-rear direction.

In addition, the foot pedal is foot-operated between a front step position in which a front side of the foot pedal is depressed from a neutral position where the rotational part of the pilot valve is in a free state and a rear step position in which a rear side of the foot pedal is depressed from the neutral position of the rotational part.

Here, in the hydraulic excavator, a working tool to be mounted on the front device differs depending upon the excavating work of earth and sand or the demolition work of buildings. In a case where the bucket is mounted on the front device, the additional pedal device is not operated. On the other hand, in a case where the additional working tool is mounted on the front device instead of the bucket, an operation of the additional pedal device becomes necessary because of an increase in the number of hydraulic actuators.

Therefore, there are some additional pedal devices that are provided with a pedal operation switching mechanism that switches movement patterns at the time of foot-operating the foot pedal. The pedal operation switching mechanism can switch the movement pattern to a fixing pattern for fixing an operation of the additional pedal device in a case where the bucket is mounted on the front device, and to an operating pattern for releasing the fixation of the additional pedal device in a case where the additional working tool is mounted on the front device. There is known an example of a pedal operation switching mechanism in which a pedal cover capable of covering a foot pedal is provided in a position lateral to the foot pedal to be rotatable (Patent Document 1).

PRIOR ART DOCUMENT

Patent Document

Patent Document 1: Japanese Patent Laid-Open No. Hei 11-336129 A

SUMMARY OF THE INVENTION

Incidentally, according to Patent Document 1, the pedal operation switching mechanism can switch the movement pattern to the fixing pattern in a case the bucket is mounted on the front device, and to the operating pattern in a case where the additional working tool is mounted on the front device. Here, cutter and grapple need two operations of an operation of depressing a front side of the foot pedal and an operation of depressing a rear side of the foot pedal for performing a clamping (pinching) movement and a releasing (opening) movement.

However, since the breaker performs only an on/off operation of a hit, an operator can operate the breaker by only one operation as the operation of depressing the front side of the foot pedal. Therefore, in a case of using the breaker, bolts and pins are preliminarily provided aside from the pedal operation switching mechanism and these bolts and pins are used to restrict the operation of depressing the rear side of the foot pedal. Accordingly, in a case of using the breaker as the working tool, a pin pulling-in/out work and a bolt fastening work are required, posing a problem of spending labors and hours for a switching work of the additional pedal device.

The present invention is made in view of the aforementioned problem in the conventional technology, and an object of the present invention is to provide a construction machine that can easily switch a foot pedal to three kinds of movement patterns by a pedal operation switching mechanism.

The present invention is applied to a construction machine comprising: an automotive vehicle body provided with a front device at a front side in a front-rear direction; a floor member provided in the vehicle body, the floor member having an operator's seat at a rear side and having a footrest part as a front side; a pilot valve including a valve case provided to bore through the floor member in a position of the footrest part, and a rotational part to be rotated in an upper-lower direction in an upper side section of the valve case projecting from the footrest part; a foot pedal that is provided in the rotational part of the pilot valve to extend in the front-rear direction and is foot-operated between a front step position in which a front side of the foot pedal is depressed from a neutral position where the rotational part of the pilot valve is in a free state and a rear step position in which a rear side of the foot pedal is depressed from the neutral position of the rotational part; and a pedal operation switching mechanism that is provided between the footrest part and the foot pedal and switches a movement pattern at the time of foot-operating the foot pedal, characterized in that: the pedal operation switching mechanism can switch the foot pedal to any movement pattern of three movement patterns of; a first movement pattern of being capable of the operation of depressing the front side of the foot pedal from the neutral position of the rotational part and of being capable of the operation of depressing the rear side of the foot pedal from the neutral position, a second movement pattern of being capable of the operation of depressing only the front side of the foot pedal from the neutral position of the rotational part, and a third movement pattern of fixing the movement of the foot pedal in the neutral position of the rotational part.

According to the present invention, the foot pedal can be easily switched to three kinds of the movement patterns by the pedal operation switching mechanism.

MODE FOR CARRYING OUT THE INVENTION

Hereinafter, a hydraulic excavator of a crawler type taken as a representative example of construction machines related to an embodiment in the present invention will be in detail explained with reference to FIG. 1 to FIG. 11.

Figure 1:
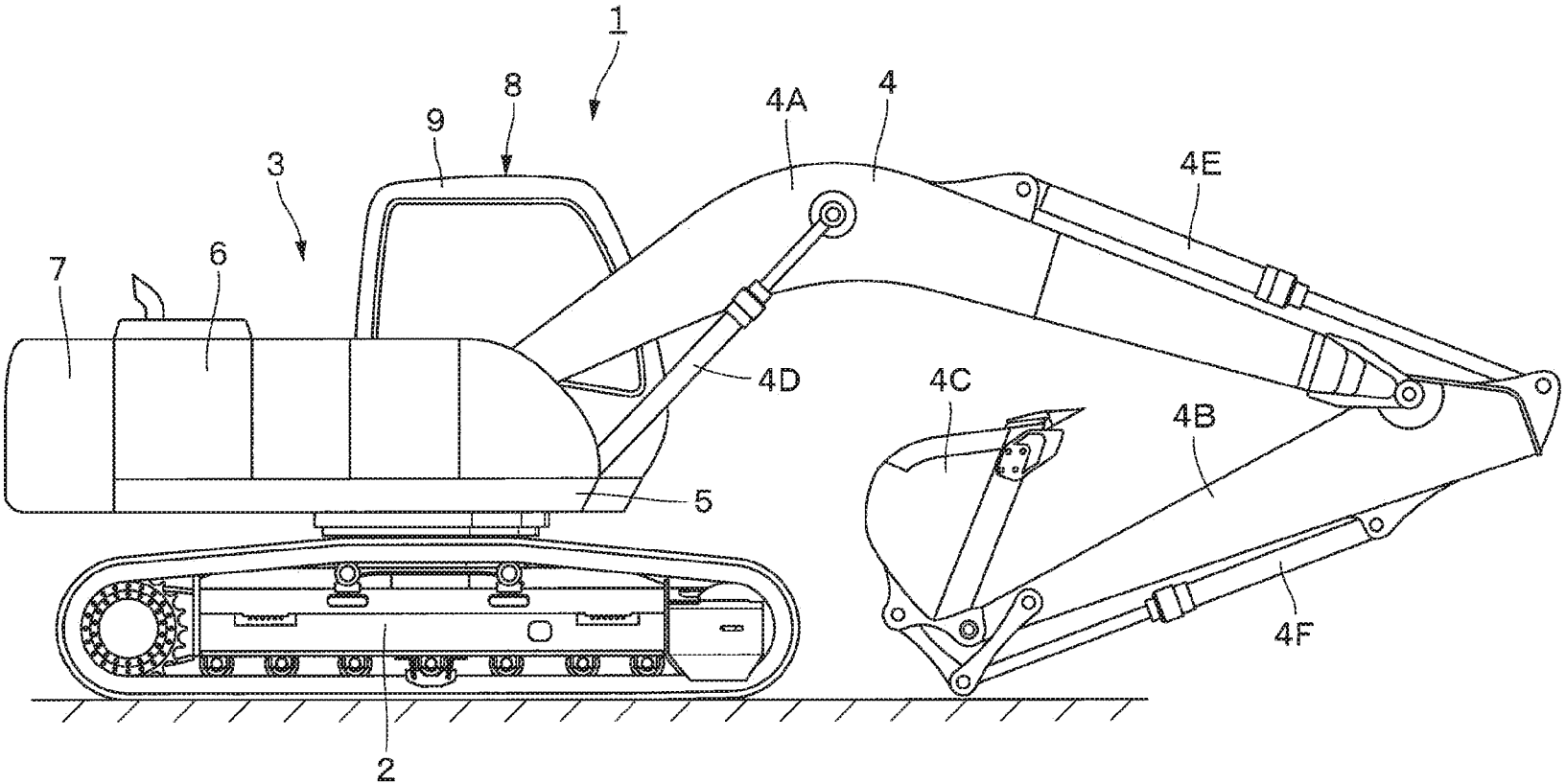
FIG. 1 is a front view showing a hydraulic excavator applied to an embodiment in the present invention.

In FIG. 1, a hydraulic excavator 1 includes an automotive lower traveling structure 2 of a crawler type, and an upper revolving structure 3 that is mounted on the lower traveling structure 2 to be capable of revolving thereon and configures a vehicle body together with the lower traveling structure 2, and a front device 4 that is provided in a front side of the upper revolving structure 3 in a front-rear direction to be capable of tilting and lifting thereto.

The front device 4 includes a boom 4A that is mounted in a front side of a revolving frame 5, which will be described later, to be capable of tilting and lifting thereto, an arm 4B that is mounted on a tip end of the boom 4A to be rotatable in an upper-lower direction, a bucket 4C as one of working tools that are mounted on a tip end of the arm 4B to be rotatable in the upper-lower direction, and a boom cylinder 4D, an arm cylinder 4E and a bucket cylinder 4F for moving these components.

Here, the bucket 4C is used for, for example, an excavating work of earth and sand, and a loading work of earth and sand. On the other hand, the hydraulic excavator 1 is used also, for example, in the demolition work of buildings and the like in addition to the excavating work of earth and sand and the loading work of earth and sand. In this case, a cutter for cutting steel frames, a grapple for clamping/transporting steel frames and concrete pieces and a breaker for breaking walls and concrete pieces (none of them is shown) as working tools are equipped in a tip end side of the arm 4B in the front device 4.

The cutter and the grapple are representative examples of working tools of needing a clamping (pinching) movement and a releasing (opening) movement. On the other hand, the breaker is a representative example of working tools that perform a simple on/off operation of continuously causing a chisel to hit a destruction target.

The upper revolving structure 3 includes a revolving frame 5 forming a support structural body, a cab 8, which will be described later, mounted in a left front side of the revolving frame 5, an exterior cover 6 for covering equipment devices including an engine, a hydraulic pump, a heat exchanger and a control valve (none of them is shown) that are positioned in a rear side of the cab 8 to be mounted on the revolving frame 5, and a counterweight 7 mounted on a rear part of the revolving frame 5.

The cab 8 is mounted in a left front side of the revolving frame 5. The cab 8 defines a residence space in which an operator gets to perform various operations. The cab 8 includes a cab box 9 formed in a boxy shape with a roof lid, and a floor member 10, which will be described later, covering a bottom part of the cab box 9.

Figure 2:
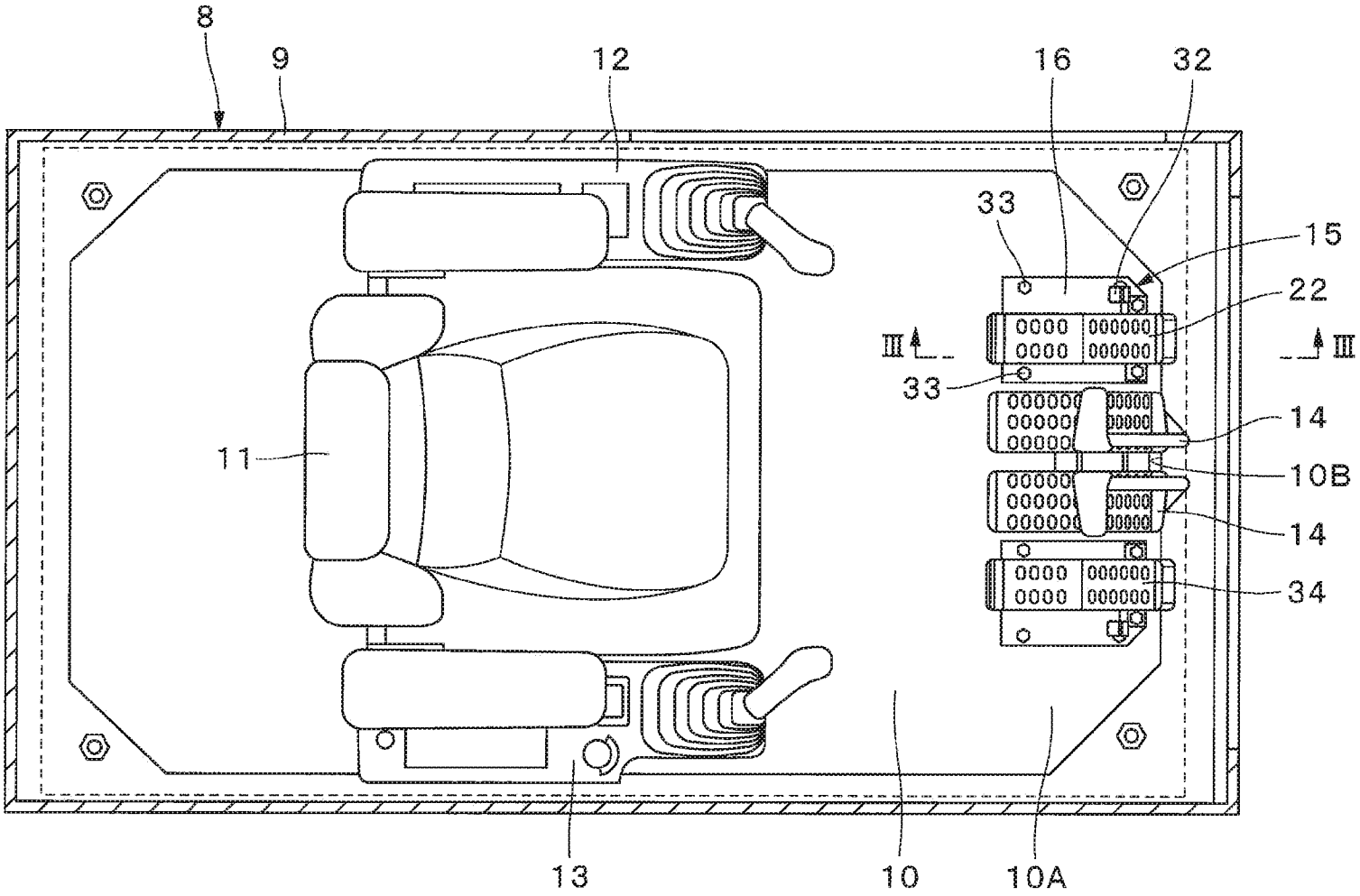
FIG. 2 is a transvers sectional view showing an inside of a cab in FIG. 1.

As shown in FIG. 2, the floor member 10 is configured as a floor surface of the cab 8. The floor member 10 is formed as a long, rectangular plate body in the front-rear direction. A front side of the floor member 10 ahead of an operator's seat 11 to be described later is configured as a footrest part 10A. The footrest part 10A is a space in which an operator seated on the operator's seat 11 rests his or her foot. In addition, a traveling pedal opening 10B positioned in an intermediate part in the left-right direction, a left side additional pedal opening 10C (refer to FIG. 3) positioned in a left side of the traveling pedal opening 10B, and a right side additional pedal opening (not shown) positioned in a right side of the traveling pedal opening 10B are formed in a front side position of the footrest part 10A. A plurality of bolt through holes (none of them is shown) are provided in the periphery of each of the openings 10B, 10C to mount a traveling control lever/pedal device 14 and an additional pedal device 15 each, which will be described later.

The operator's seat 11 is provided in an intermediate part of the floor member 10 in the front-rear direction. The operator's seat 11 is for an operator to sit on. In addition, a left side working control lever device 12 and a right side working control lever device 13 each are provided in both left and right sides of the operator's seat 11 to control the front device 4 and the revolving device. On the other hand, left and right traveling control lever/pedal devices 14 are provided on the footrest part 10A of the floor member 10 as a front side of the operator's seat 11 to be positioned in the traveling pedal opening 10B and cause the lower traveling structure 2 to travel. In addition, an additional pedal device 15 to be described later is provided on a left side of the traveling control lever/pedal device 14. Further, another additional pedal device 34 is provided in a right side of the traveling control lever/pedal device 14.

Next, an explanation will be in detail made of the configuration, the movement and the switching work of the additional pedal device 15 as a characteristic portion of the present invention. It should be noted that the additional pedal device 15 is assembled to a base plate 16 configuring a part of the floor member 10 for facilitating an assembling work and an adjustment work after the assembling.

Figure 5:
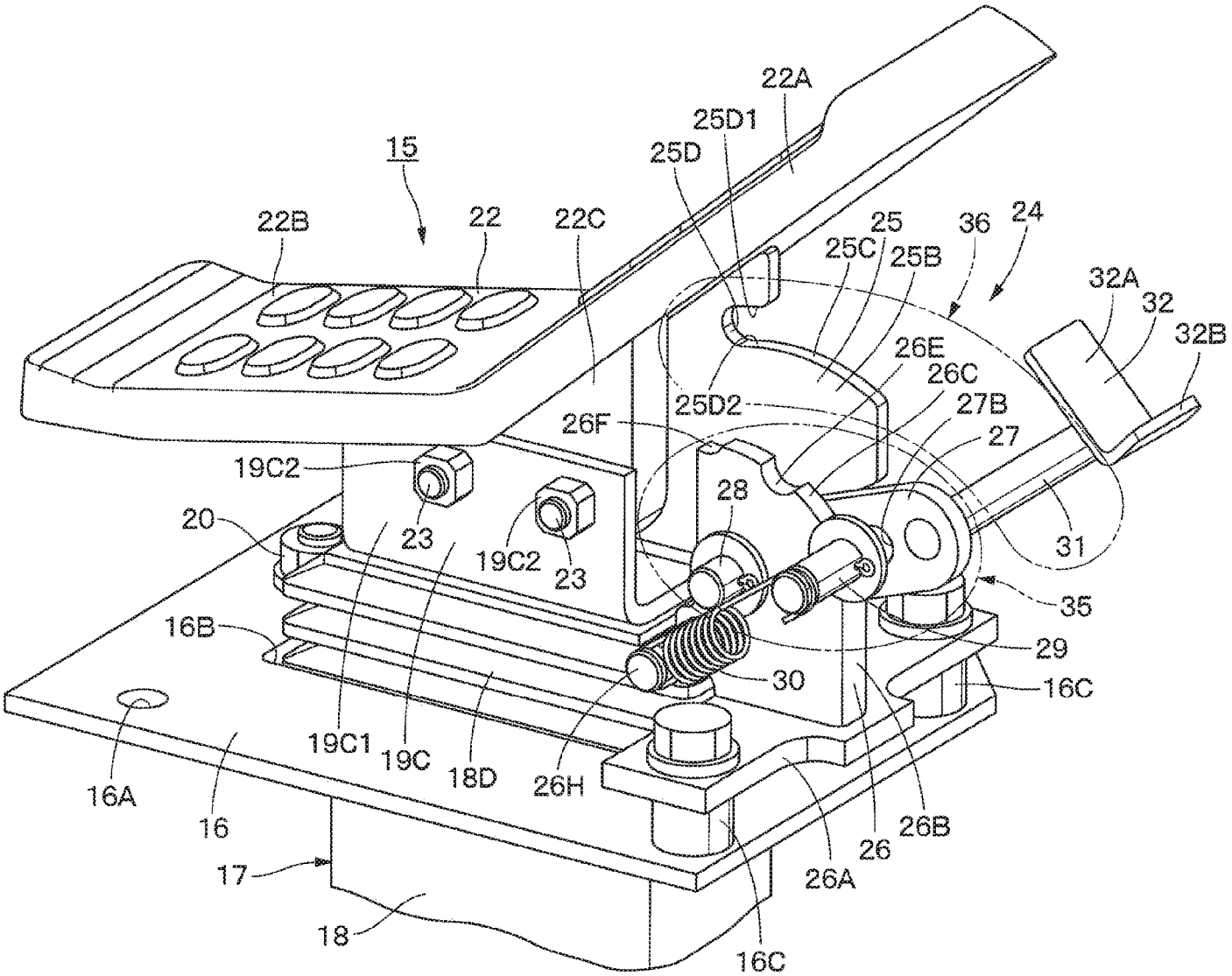
FIG. 5 is a perspective view showing the additional pedal device, as viewed from a right front side.
Figure 6:
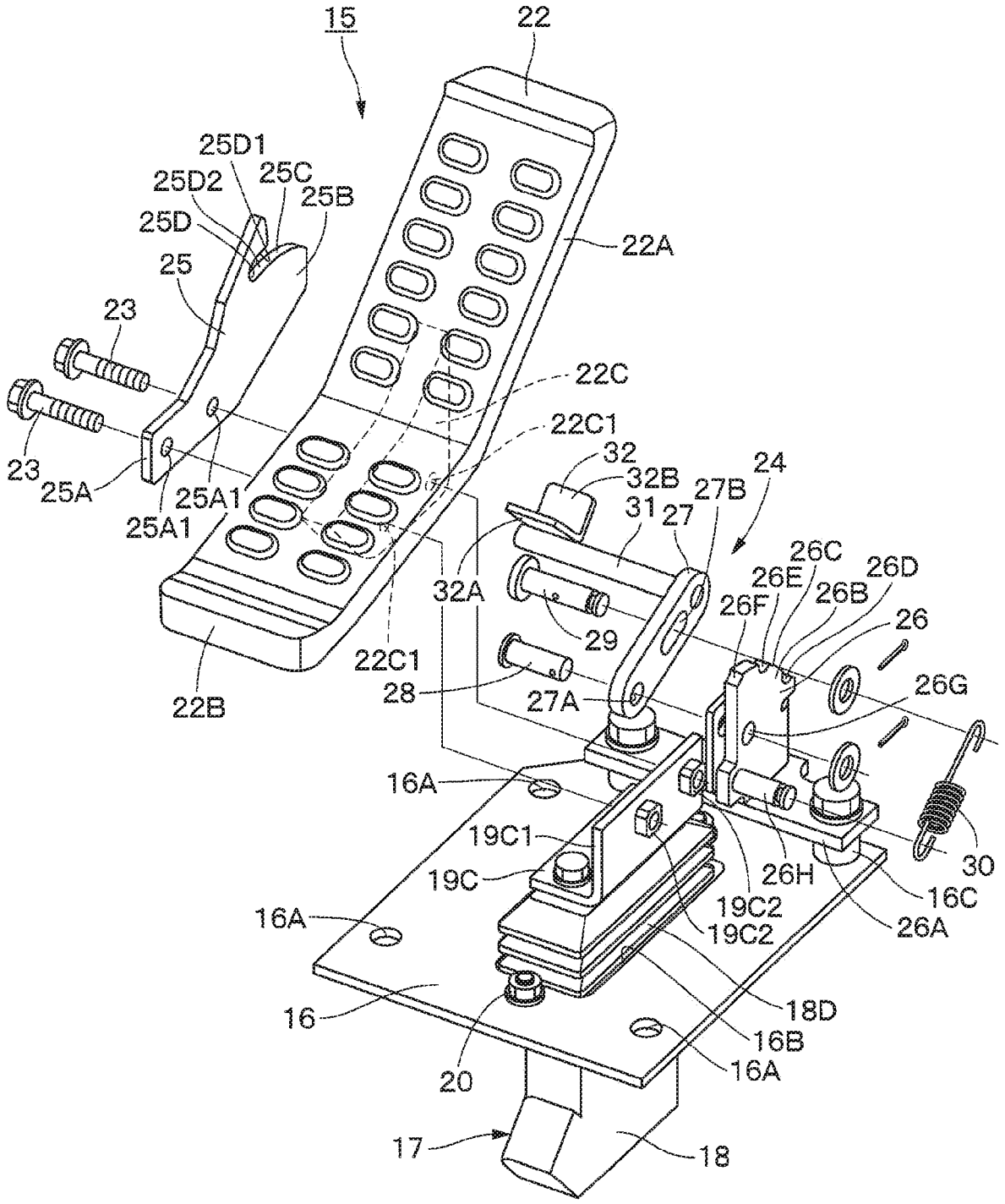
FIG. 6 is an exploded perspective view showing the additional pedal device in an exploded manner.

As shown in FIG. 5 and FIG. 6, the base plate 16 is formed as a rectangular plate body long in the front-rear direction. For example, the base plate 16 is provided with bolt through holes 16A formed in three locations of a left front position, a left rear position, and a right rear position. In addition, a valve through opening 16B extending in the front-rear direction and bolt through holes (not shown) that are positioned in front of and in back of the valve through opening 16B and bore in the upper-lower direction are provided in an intermediate position of the base plate 16 in the left-right direction. A valve case 18 in a pilot valve 17 to be described later is inserted in the valve through opening 16B. A valve mounting bolt and nut 20 is inserted in each of the bolt through holes to mount the pilot valve 17. Further, positioning member mounting seats 16C for mounting a positioning member 26 to be described later are provided with an interval in the left-right direction in a front side position of the base plate 16.

The additional pedal device 15 is provided in the footrest part 10A of the floor member 10 to be positioned in the left side of the traveling control lever/pedal device 14. The additional pedal device 15 is formed of the pilot valve 17, a foot pedal 22 and a pedal operation switching mechanism 24, which will be described later. The additional pedal device 15 can be used as a footrest by fixing its movement when the bucket 4C is equipped as a working tool in the front device 4. In addition, when the cutter or the grapple is equipped as the working tool of the front device 4, it is possible to perform an operation of depressing the front side of the foot pedal 22 and an operation of depressing the rear side of the foot pedal 22. Further, when the breaker is equipped as the working tool of the front device 4, it is possible to perform only the operation of depressing the front side of the foot pedal 22.

The pilot valve 17 is mounted on the base plate 16 configuring a part of the floor member 10 and is arranged on the footrest part 10A of the floor member 10 through the base plate 16. The pilot valve 17 is configured as a pilot valve of a pressure reducing valve type, and controls supply/discharge of a pilot pressure to a control valve device (not shown). The pilot valve 17 is provided with the cuboid valve case 18 that is formed to be flat in the left-right direction, and a rotational part 19 that is provided in an upper side section of the valve case 18 and is rotated in the upper-lower direction about a rotational axis line extending in the left-right direction.

The valve case 18 is provided to bore through the floor member 10 in a position of the footrest part 10A. Specifically, amounting flange 18A is provided in an upper side of the valve case 18 to extend in the front-rear direction. The mounting flange 18A is mounted on the base plate 16 using the valve mounting bolt and nut 20. In addition, the valve case 18 is provided with pushers 18B, 18C displaceable in the upper-lower direction to project to an upper side in the front-rear position across the rotational shaft 21. Further, a bellows-shaped boot 18D is provided on an upper side of the valve case 18 to cover the rotational part 19 to be described later.

Moreover, the rotational part 19 is mounted in an upper side section of the valve case 18 to be capable of swinging in the front-rear direction through the rotational shaft 21 extending in the left-right direction between the pushers 18B, 18C. The rotational part 19 has a front abutting surface 19A pushing down the pusher 18B in the front side when a front side section of the rotational part 19 is rotated downward and the rear abutting surface 19B pushing down the pusher 18C in the rear side when a rear side section of the rotational part 19 is rotated downward. Further, a mounting bracket 19C is mounted integrally on an upper side of the rotational part 19 to mount the foot pedal 22 and a stay receiving member 25. Screw holes (welding nuts) 19C2 are provided on a vertical surface part 19C1 of the mounting bracket 19C with an interval in the front-rear direction.

When the foot pedal 22 is foot-operated to rotate in the upper-lower direction, each of the pushers 18B, 18C of the pilot valve 17 displaces in the upper-lower direction. Thereby, a hydraulic pilot signal is outputted to a switching valve that supplies/discharges pressurized oil to/from the additional working tools including the cutter, the grapple and the breaker replacing the bucket 4C. As a result, a hydraulic pump suctions/delivers the pressurized oil from/to the additional working tools in accordance with foot-operation of the foot pedal 22.

The foot pedal 22 is provided in the rotational part 19 of the pilot valve 17 to extend in the front-rear direction. The foot pedal 22 is foot-operated between a front step position (position shown in FIG. 7) in which a front side of the foot pedal 22 is depressed from a neutral position (position shown in FIG. 3) where the rotational part 19 of the pilot valve 17 is in a free state and a rear step position (position shown in FIG. 8) in which a rear side of the foot pedal 22 is depressed from the neutral position of the rotational part 19.

The foot pedal 22 has a front step plate part 22A formed in a front side from a folding position positioned above the rotational shaft 21 of the pilot valve 17 and a rear step plate part 22B formed in a rear side from the folding position. In addition, a mounting plate part 22C extending downward from a rear surface side of the folding position is provided on the foot pedal 22. As shown in FIG. 6, two bolt through holes 22C1 are provided in a lower side position of the mounting plate part 22C to be spaced in the front-rear direction. The bolt through holes 22C1 are provided in a position corresponding to the two screw holes 19C2 provided on the vertical surface part 19C1 of the mounting bracket 19C forming the rotational part 19. The foot pedal 22 is mounted on the rotational part 19 together with the stay receiving member 25 by screwing pedal mounting bolts 23 inserted respectively in the bolt through holes 22C1 into the screw holes 19C2 of the mounting bracket 19C.

An operator who has sat on the operator's seat 11 can place his or her left foot on the foot pedal 22. When the front step plate part 22A of the foot pedal 22 is depressed to a lower side by a toe side of the foot in this state, it is possible to rotate the front side of the rotational part 19 of the pilot valve 17 to the lower side. On the other hand, when the rear step plate part 22B of the foot pedal 22 is depressed to a lower side by a heel side of the foot, it is possible to rotate the rear side of the rotational part 19 of the pilot valve 17 to the lower side. At the time of this pedal operation, the rotational part 19 of the pilot valve 17, the foot pedal 22 and the stay receiving member 25 to be described later rotate together.

Next, an explanation will be made of the configuration of the pedal operation switching mechanism 24 as the characteristic portion of the present invention and an example of steps for switching movement patterns of a foot operation by the pedal operation switching mechanism 24.

The pedal operation switching mechanism 24 is provided between the footrest part 10A of the floor member 10 and the foot pedal 22 to be positioned in front side of the rotational part 19. The pedal operation switching mechanism 24 switches a movement pattern (state of the movement) of foot-operating the foot pedal 22 to any movement pattern of three movement patterns composed of a front/rear step pattern, which will be described later, as a first movement pattern, a front step limit pattern as a second movement pattern, and a fixing pattern as a third movement pattern. The pedal operation switching mechanism 24 includes the stay receiving member 25, a positioning member 26, a rotational arm 27, an engaging member 29, a spring member 30, a restricting stay 31 and a switching operation part 32, which will be described later.

The stay receiving member 25 configures a part of a pedal operation restricting section 36 to be described later. The stay receiving member 25 is provided in the rotational part 19 to extend in front to a rotational center of the rotational part 19 of the pilot valve 17, that is, the rotational shaft 21. The stay receiving member 25 is rotated together with the rotational part 19 and the foot pedal 22. As shown in FIG. 6, the stay receiving member 25 is formed as a plate member extending in the front-rear direction.

Besides, the stay receiving member 25 is formed of a rectangular mounting part 25A positioned in the rear side in the front-rear direction and a cam plate part 25B extending from the mounting part 25A to the positioning member 26. In addition, the stay receiving member 25 is provided with a rear step restricting part 25C that is formed in an arc shape extending in the front-rear direction in an upper side position of the cam plate part 25B, and a U letter-shaped fixing groove part 25D that is formed in the cam plate part 25B to be continuous to the rear side of the rear step restricting part 25C and is open to the front side.

Two bolt through holes 25A1 corresponding to the two bolt through holes 22C1 of the mounting plate part 22C configuring the foot pedal 22 is provided in the mounting part 25A. Accordingly, the mounting part 25A of the stay receiving member 25 abuts on the mounting plate part 22C of the foot pedal 22 from the left side. In this state, the pedal mounting bolts 23 inserted in the respective bolt through holes 25A1 of the stay receiving member 25 and in the respective bolt through holes 22C1 of the mounting plate part 22C are screwed in the screw holes 19C2 of the mounting bracket 19C. Thereby, the stay receiving member 25 can be mounted on the rotational part 19 together with the foot pedal 22.

The rear step restricting part 25C is formed along an arc drawn centering the rotational center (mounting shaft 28) of the rotational arm 27 in a neutral position in which the rotational part 19 of the pilot valve 17 is in a free state (state where a foot is not placed on). Thereby, when the rotational arm 27 rotates to the rear side, the restricting stay 31 can smoothly move to the upper side of the rear step restricting part 25C.

Figure 9:
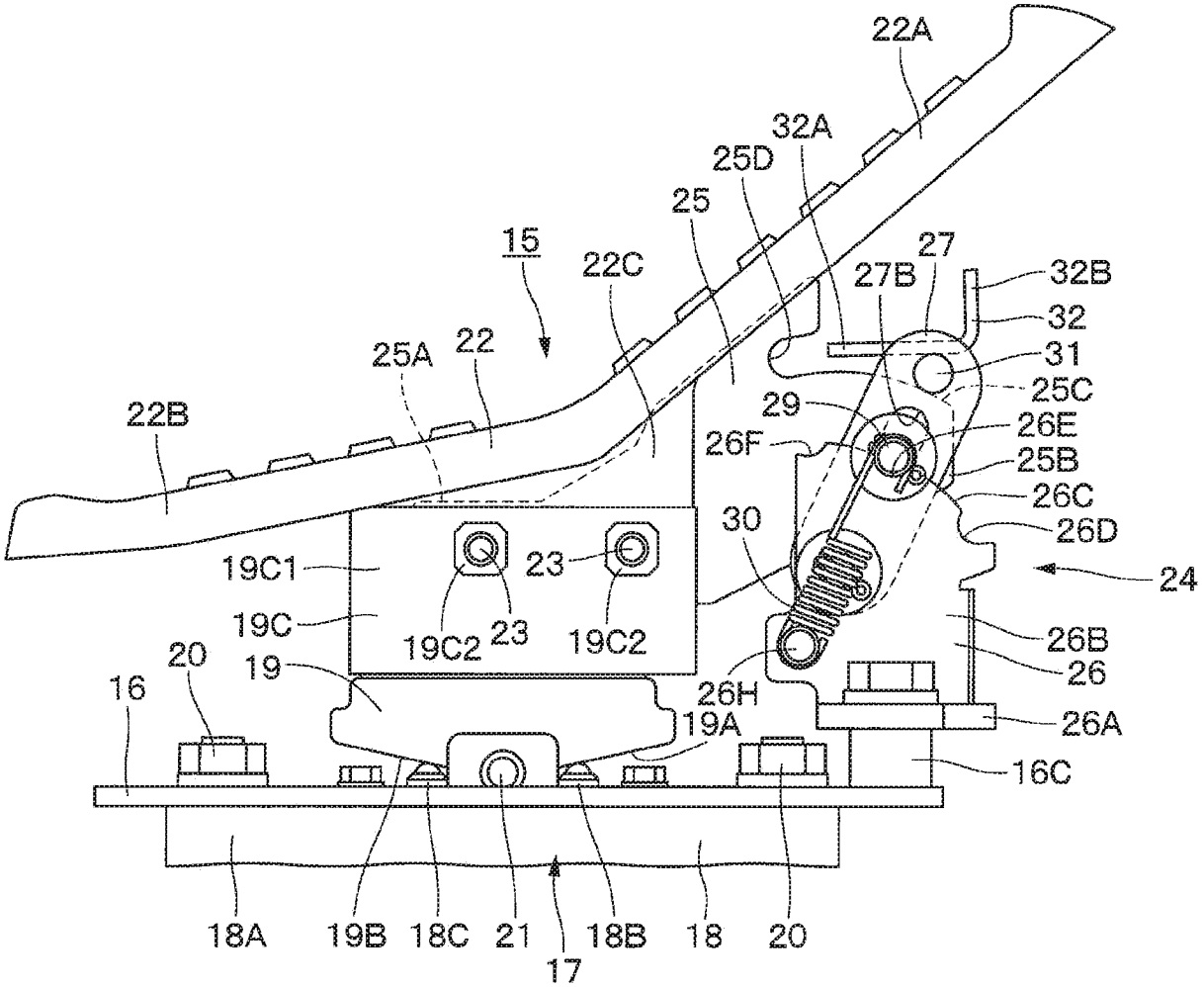
FIG. 9 is a front view showing the additional pedal device switched to a front step limit pattern with the boot being removed.

As shown in FIG. 9, the rear step restricting part 25C, when the pedal operation switching mechanism 24 is switched to the front step limit pattern, that is, when the rotational arm 27 is rotated to the rear side to cause the engaging member 29, which will be described later, to be engaged with an intermediate recessed groove part 26E of the positioning member 26, can abut on the restricting stay 31 from the lower side. Thereby, an upper surface (curved surface) of the rear step restricting part 25C abuts on the restricting stay 31 at the time of performing the rear step operation of the foot pedal 22, thus making it possible to restrict the rear step operation.

The fixing groove part 25D is formed to be continuous to the rear side of the rear step restricting part 25C in the neutral position of the rotational part 19 of the pilot valve 17. In addition, the fixing groove part 25D is formed as a notched part in a U-letter shape open to the front side. Thereby, the fixing groove part 25D includes a front step abutting part 25D1 abutting on the fitted restricting stay 31 from the lower side and a rear step abutting part 25D2 abutting on the fitted restricting stay 31 from the upper side.

Figure 11:
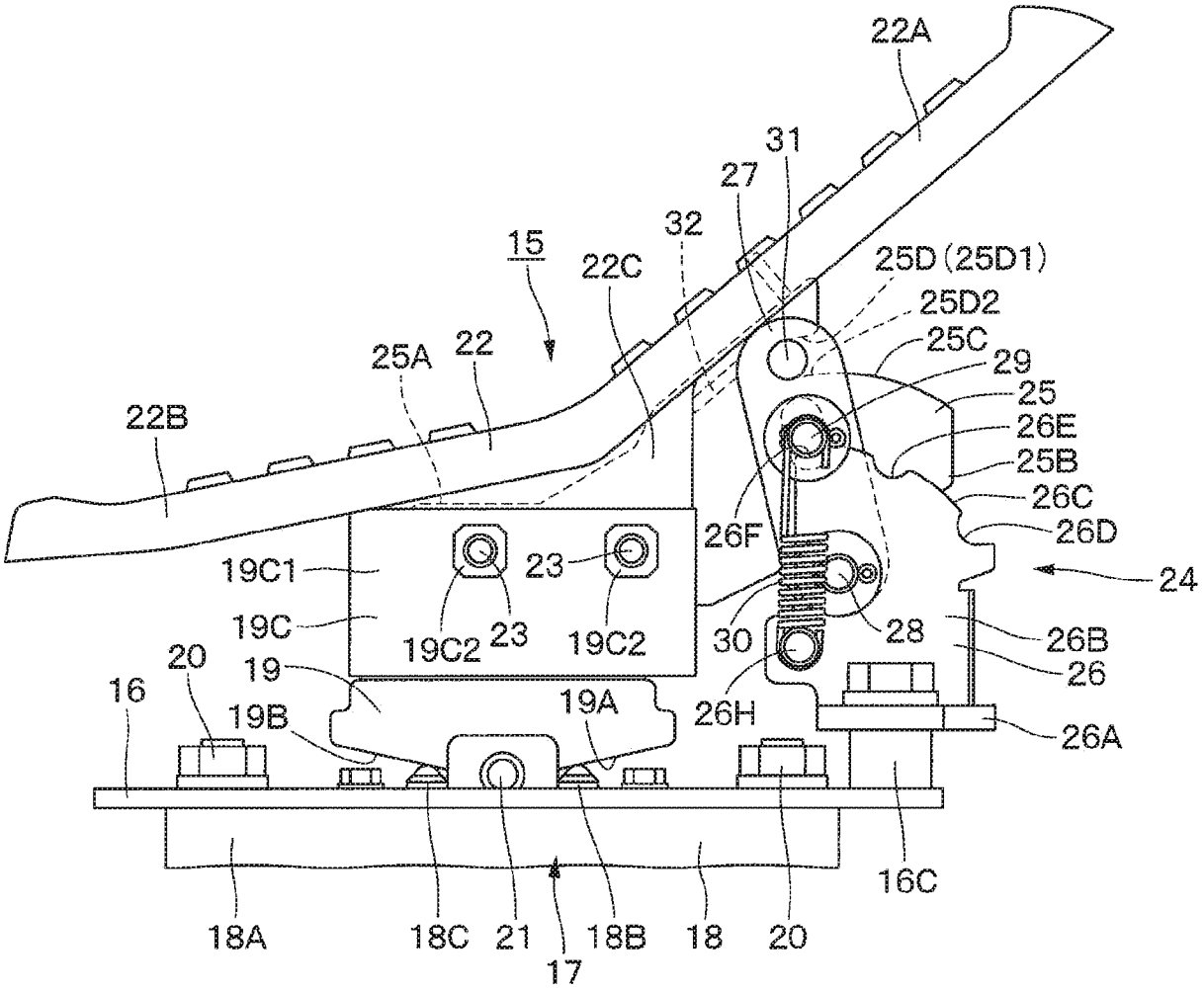
FIG. 11 is a front view showing the additional pedal device switched to a fixing pattern with the boot being removed.

As shown in FIG. 11, the fixing groove part 25D can sandwich upper and lower sides of the restricting stay 31 to be fixed when the pedal operation switching mechanism 24 is switched to the fixing pattern, that is, when the rotational arm 27 is further rotated to the rear side to cause the engaging member 29 to be engaged with a rear recessed groove part 26F of the positioning member 26. Thereby, the fixing groove part 25D can restrict the operation (both of the front step operation and the rear step operation) of the foot pedal 22.

The positioning member 26 configures a part of a movement pattern switching section 35 to be described later. The positioning member 26 is projected upward on the floor member 10 in front side of the mounting bracket 19C of the rotational part 19 and in a position facing the stay receiving member 25. Specifically, as shown in FIG. 5 and FIG. 6, the positioning member 26 includes a platform plate 26A that is provided on each of positioning member mounting seats 16C of the base plate 16 configuring a part of the floor member 10 and extends in the left-right direction, a vertical plate part 26B that is projected upward on an intermediate part of platform plate 26A in the left-right direction, an arc-shaped part 26C that is formed in an arc shape to be positioned in the upper side of the vertical plate part 26B and lower toward the front side, a front recessed groove part 26D, an intermediate recessed groove part 26E and a rear recessed groove part 26F that are formed to be spaced in the circumferential direction (front-rear direction) on an outer periphery of the arc-shaped part 26C, a shaft hole 26G that is disposed in the left-right direction through the vertical plate part 26B closer to the rear side than the intermediate part in the upper-lower direction, and a spring hook shaft 26H that is positioned closer to a lower side than the shaft hole 26G and is projected to the right side from the vertical plate part 26B.

The vertical plate part 26B is arranged in a right side to the stay receiving member 25 in front side of the mounting bracket 19C and is formed as a plate body extending in the front-rear direction. In addition, the shaft hole 26G is for the mounting shaft 28 of the rotational arm 27 to be inserted in. One side of the spring member 30 is hooked on the spring hook shaft 26H.

Figure 3:
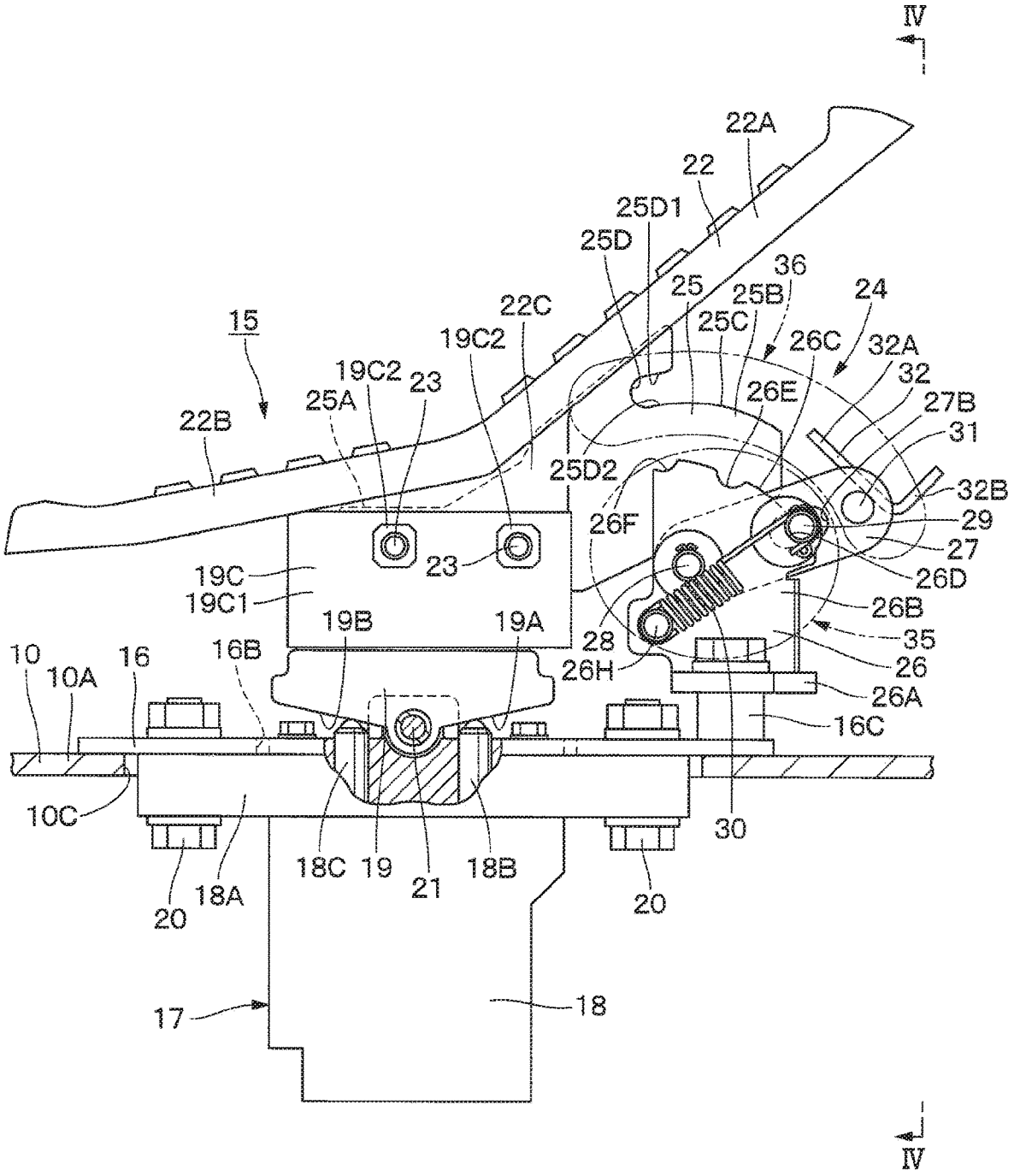
FIG. 3 is a partially broken, enlarged sectional view showing an additional pedal device in a state of being switched to a front/rear step pattern, as viewed in a direction of arrows III-III in FIG. 2.
Figure 4:
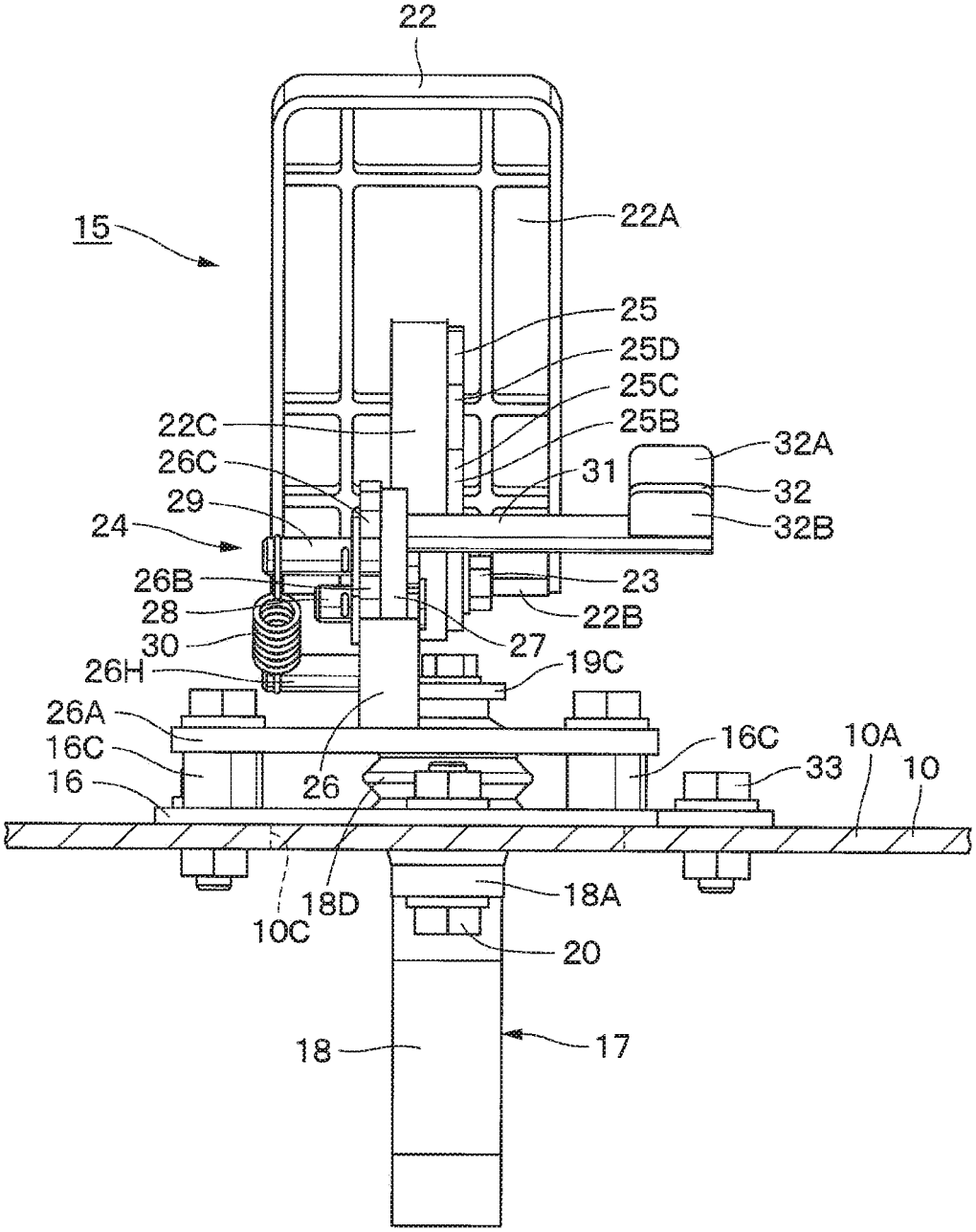
FIG. 4 is a sectional view showing the additional pedal device, as viewed in a direction of arrows IV-IV in FIG. 3.

Here, the engaging member 29 to be described later is detachably engaged with the three parts of the front recessed groove part 26D, the intermediate recessed groove part 26E and the rear recessed groove part 26F that are formed on the outer periphery side of the arc-shaped part 26C. Therefore, each of the recessed groove parts 26D, 26E, 26F is formed as a shallow, arc groove such that the engaging member 29 is fitted therein by approximately one-third of a diameter dimension thereof, for example. The engaging member 29 is engaged with the front recessed groove part 26D in the front/rear step pattern as shown in FIG. 3. In addition, the engaging member 29 is engaged with the intermediate recessed groove part 26E in the front step limit pattern as shown in FIG. 9. Further, the engaging member 29 is engaged with the rear recessed groove part 26F in the fixing pattern as shown in FIG. 11.

The rotational arm 27 configures a part of the movement pattern switching section 35. The rotational arm 27 is formed of a long plate body, and a shaft through hole 27A is formed in a base end side of the rotational arm 27 in a length direction therethrough in the left-right direction. In addition, a long hole 27B extending in the length direction is provided in an intermediate part of the rotational arm 27 in the length direction. The long hole 27B allows the engaging member 29, which will be described later, to move in the front-rear direction. Further, a tip end side of the rotational arm 27 becomes a free end, which extends longer to the front side in the length direction than each of the recessed groove parts 26D, 26E, 26F of the arc-shaped part 26C of the positioning member 26. The restricting stay 31 is mounted on the tip end side of the rotational arm 27. The mounting shaft 28 is inserted in the shaft through hole 27A of the rotational arm 27, and the mounting shaft 28 is inserted in the shaft hole 26G of the positioning member 26 in a pullout preventive state. Thereby, the rotational arm 27 is provided in the positioning member 26 to be rotatable thereto in the front-rear direction.

The engaging member 29 configures a part of the movement pattern switching section 35. The engaging member 29 is inserted in the long hole 27B of the rotational arm 27 in the left-right direction. Thereby, the long hole 27B allows the engaging member 29 to move in the length direction of the rotational arm 27. When the engaging member 29 moves along the long hole 27B, the engaging member 29 can be selectively engaged with the three recessed groove parts 26D, 26E, 26F provided in the positioning member 26.

The spring member 30 is provided between the positioning member 26 and the engaging member 29. The spring member 30 causes the engaging member 29 to be urged toward each of the recessed groove parts 26D, 26E, 26F. The spring member 30 is formed as a helical extension spring, and one end of the spring member 30 is hooked on a tip end part of the spring hook shaft 26H of the positioning member 26, and the other end is hooked on a tip end part of the engaging member 29. The urging force of the spring member 30 is set to the degree of allowing the engaging member 29 to be disengaged from each of the recessed groove parts 26D, 26E, 26F at the time of rotating the rotational arm 27 with a little strengthened force by an operator's foot in a state where the engaging member 29 is engaged with any of the respective recessed groove parts 26D, 26E, 26F.

The restricting stay 31 configures a part of the pedal operation restricting section 36 to be described later. The restricting stay 31 is formed of a round bar body extending in the left-right direction, and a right end part thereof as the base end side is mounted integrally on the tip end side of the rotational arm 27. On the other hand, the left end part as the tip end side becomes a free end, which extends to a position beyond the foot pedal 22.

Here, as shown in FIG. 3, in the front/rear step pattern as the first movement pattern in which the engaging member 29 is engaged with the front recessed groove part 26D of the positioning member 26, the restricting stay 31 is arranged ahead of the tip end of the rear step restricting part 25C of the stay receiving member 25, and the restricting stay 31 is disengaged from the stay receiving member 25. As shown in FIG. 9, in the front step limit pattern as the second movement pattern in which the engaging member 29 is engaged with the intermediate recessed groove part 26E of the positioning member 26, the restricting stay 31 is arranged in a position of abutting on an upper surface of the rear step restricting part 25C of the stay receiving member 25. Further, as shown in FIG. 11, in the fixing pattern as the third movement pattern in which the engaging member 29 is engaged with the rear recessed groove part 26F of the positioning member 26, the restricting stay 31 is arranged in such a manner as to be sandwiched in the fixing groove part 25D of the stay receiving member 25 from the upper and lower sides.

The switching operation part 32 is provided in a free end side (tip end side) of the restricting stay 31. The switching operation part 32 switches an engaging position of the engaging member 29 to each of the recessed groove parts 26D, 26E, 26F of the positioning member 26 against the spring member 30. For example, the switching operation part 32 is formed by folding a rectangular plate body to an L-letter shape. The switching operation part 32 has a long part 32A and a short part 32B. Besides, in the front step limit pattern where the engaging member 29 is engaged with the intermediate recessed groove part 26E of the positioning member 26 (refer to FIG. 9), the long part 32A of the switching operation part 32 is welded to the tip end side of the restricting stay 31 in such a manner that the short part 32B is directed upward.

Thereby, the switching operation part 32 can move the short part 32B in the front-rear direction by pushing the short part 32B with a toe of a shoe of an operator or by hooking a shoe bottom on the short part 32B. Therefore, the operator operates the switching operation part 32 by his or her left foot in a state of being seated on the operator's seat 11, thus making it possible to switch the movement pattern of the pedal operation switching mechanism 24.

In the additional pedal device 15, the pilot valve 17 and the pedal operation switching mechanism. 24 are mounted to the base plate 16 configuring the floor member 10. Further, the additional pedal device 15 can be assembled as a subassembly by mounting the foot pedal 22 to the pilot valve 17. In addition, as shown in FIG. 3, the additional pedal device 15 is mounted on the footrest part 10A of the floor member 10 using bolts 33 (refer to FIG. 2 and FIG. 4) inserted in the respective bolt through holes 16A of the base plate 16 in a state where the pilot valve 17 is arranged in the additional pedal opening 10C of the floor member 10.

As shown in FIG. 2, another additional pedal device 34 is provided in the footrest part 10A of the floor member 10 to be positioned in a right side to the traveling control lever/pedal device 14. The another additional pedal device 34 has the configuration and the function as similar to those of the additional pedal device 15.

Here, as shown in FIG. 3 and FIG. 5, the pedal operation switching mechanism 24 is formed of the movement pattern switching section 35 of performing the switching of the movement pattern in order of the front/rear step pattern, the front step limit pattern and the fixing pattern from the front side of the foot pedal 22 in the front-rear direction, and the pedal operation restricting section 36 that restricts the rear step operation of the foot pedal 22 at the time of being switched to the front step limit pattern by the movement pattern switching section 35 and restricts the operation of the foot pedal 22 at the time of being switched to the fixing pattern.

That is, as descriptions are made specifically of the pedal operation switching mechanism 24, the movement pattern switching section 35 includes the positioning member 26, the rotational arm 27 and the engaging member 29. The movement pattern switching section 35 performs the switching of the movement pattern in order of the front/rear step pattern, the front step limit pattern and the fixing pattern from the front side of the foot pedal 22 in the front-rear direction. In addition, the pedal operation restricting section 36 includes the stay receiving member 25 and the restricting stay 31. The pedal operation restricting section 36 restricts the rear step operation of the foot pedal 22 at the time of being switched to the front step limit pattern by the movement pattern switching section 35 and restricts the operation of the foot pedal 22 at the time of being switched to the fixing pattern by the movement pattern switching section 35.

Accordingly, the movement pattern switching section 35 has a function (operation) of accurately performing the switching of the movement pattern in order of the front/rear step pattern, the front step limit pattern and the fixing pattern. Moreover, the pedal operation restricting section 36 has a function (operation) of restricting the rear step operation of the foot pedal 22 at the time of being switched to the front step limit pattern by the movement pattern switching section 35 and restricting the operation of the foot pedal 22 at the time of being switched to the fixing pattern by the movement pattern switching section 35.

The hydraulic excavator 1 according to the present embodiment has the configuration as described above, and next, a movement thereof will be explained.

First, an operator gets in the cab 8 and sits on the operator's seat 11. The operator having sat on the operator's seat 11 controls each of the traveling control lever/pedal devices 14, making it possible to cause the lower traveling structure 2 to travel. On the other hand, when the operator controls the left and right side working control lever devices 12, 13 each, it is possible to perform the revolving movement of the upper revolving structure 3 and the excavating work of earth and sand by the bucket 4C in the front device 4.

Here, the hydraulic excavator 1 is used also for the demolition work of buildings in addition to the excavating work of earth and sand using the bucket 4C in the front device 4. In this case, the front device 4 is equipped with the cutter for cutting steel frames, the grapple for transporting steel frames and concrete pieces and the breaker for breaking walls and concrete pieces as additional working tools. The additional pedal device 15 for controlling these additional working tools has the movement patterns that are switched in accordance with the working tool equipped in the front device 4 by the pedal operation switching mechanism 24.

That is, in a case where the bucket 4C is mounted on the front device 4, the pedal operation switching mechanism 24 is switched to the fixing pattern. In addition, in a case where the cutter or the grapple is mounted on the front device 4, the pedal operation switching mechanism 24 is switched to the front/rear step pattern. Further, in a case where the breaker is mounted on the front device 4, the pedal operation switching mechanism 24 is switched to the front step limit pattern.

Next, an explanation will be made of the switching steps of the movement patterns by the pedal operation switching mechanism 24 with reference to FIG. 3 to FIG. 11.

First, descriptions will be made of a case where the tool, such as the cutter or grapple, performing an opening/closing movement by an operation of the additional pedal device 15 is mounted on the front device 4. In this case, as shown in FIG. 3, the pedal operation switching mechanism 24 is in the front/rear step pattern with the engaging member 29 being engaged with the front recessed groove part 26D of the positioning member 26. In the front/rear step pattern, the restricting stay 31 is out of alignment closer to the front side than the tip end of the rear step restricting part 25C of the stay receiving member 25.

Figure 7:
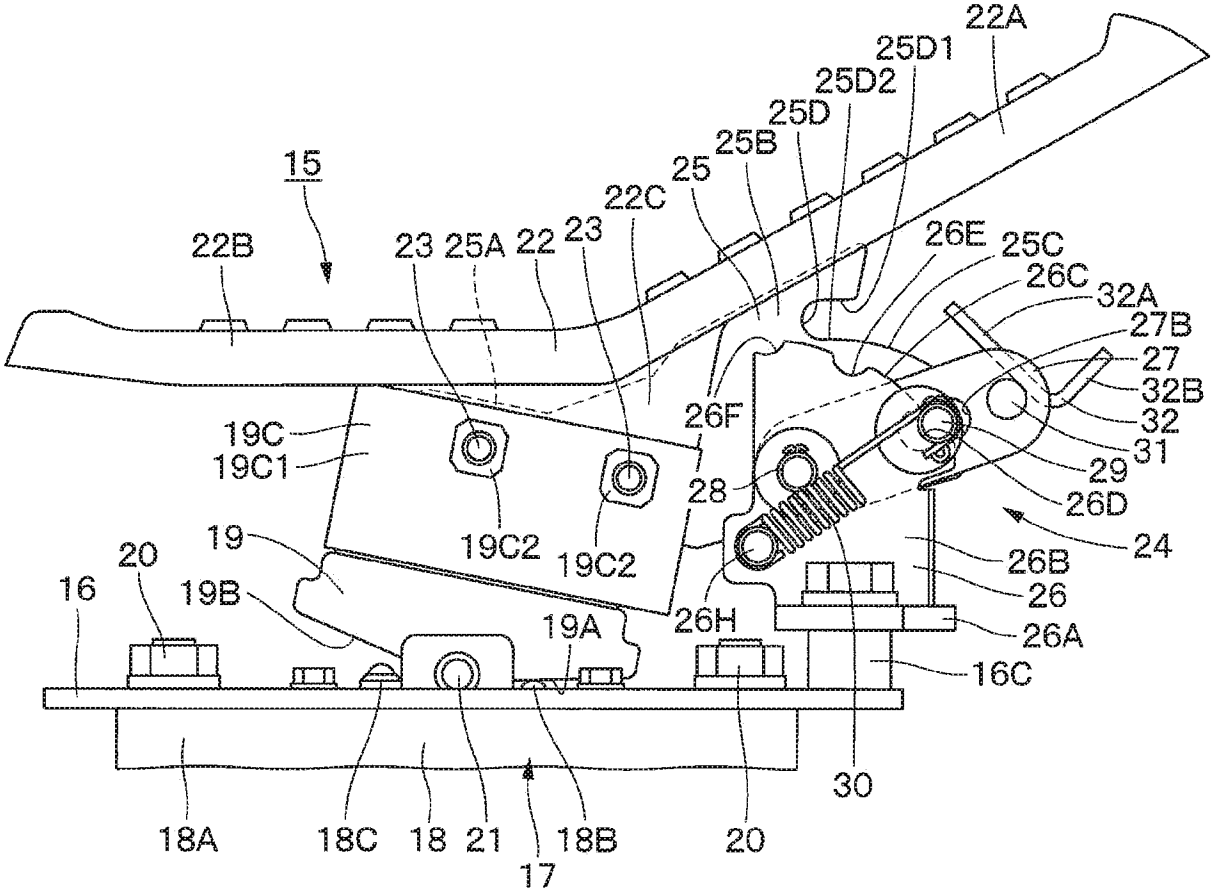
FIG. 7 is a front view showing a state of depressing a front side of a foot pedal of the additional pedal device switched to a front/rear step pattern with a boot being removed.

Accordingly, as shown in FIG. 7, the operator depresses the front step plate part 22A from the neutral position of the rotational part 19 of the pilot valve 17. Thereby, the front side of the rotational part 19 can rotate downward together with the foot pedal 22. In this front step operation, it is possible to push the pusher 18B positioned in the front side of the valve case 18 by the rotational part 19.

Figure 8:
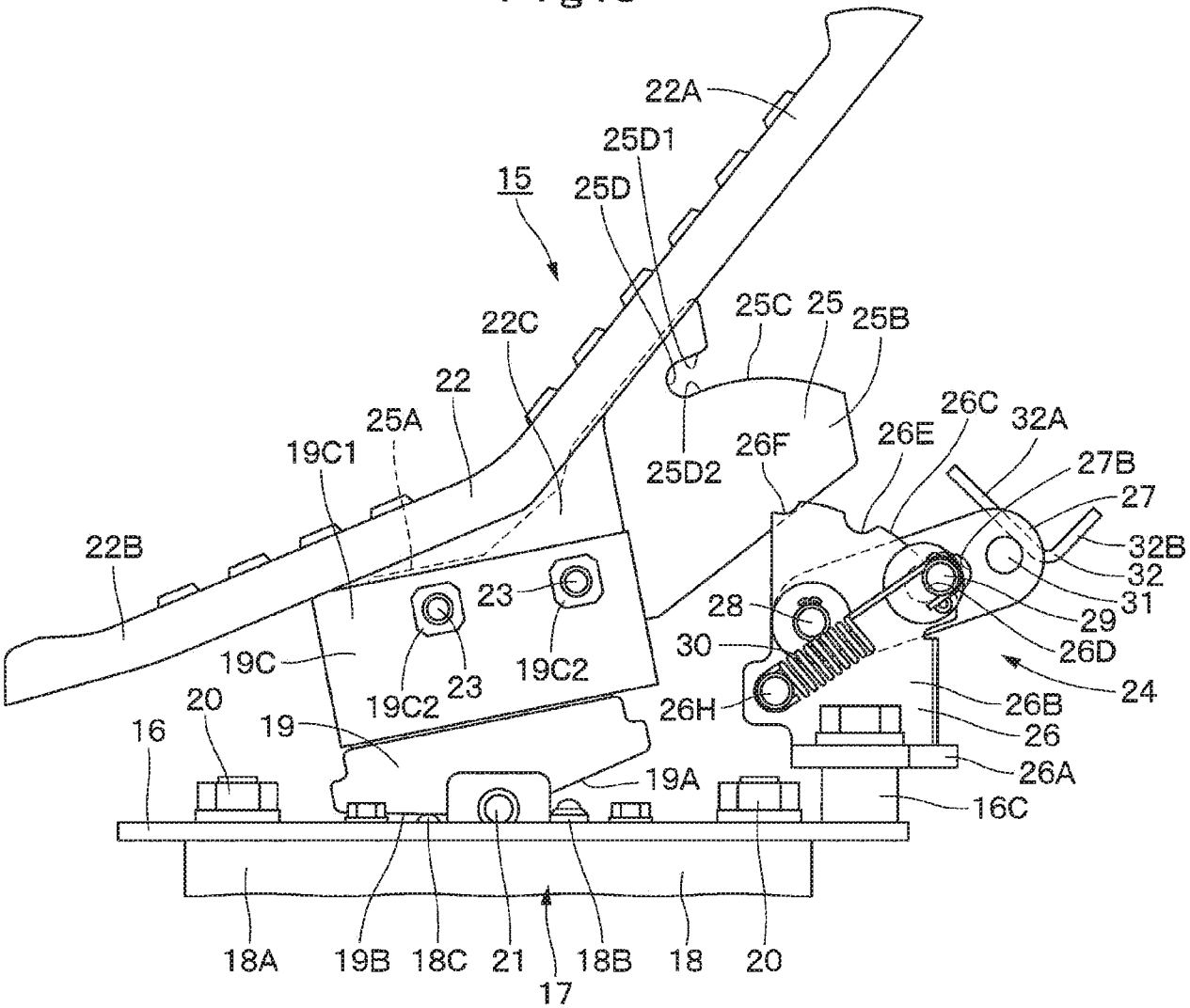
FIG. 8 is a front view showing a state of depressing a rear side of the foot pedal of the additional pedal device switched to the front/rear step pattern with the boot being removed.

On the other hand, as shown in FIG. 8, the operator depresses the rear step plate part 22B from the neutral position of the rotational part 19. Thereby, the rear side of the rotational part 19 can rotate downward together with the foot pedal 22. In this rear step operation, it is possible to push the pusher 18C positioned in the rear side of the valve case 18 by the rotational part 19.

Next, descriptions will be made of a case where the tool, such as the breaker, performing an on/off (drive/stop) movement of a hit by an operation of the additional pedal device 15 is mounted on the front device 4. In this case, timing of depressing the front step plate part 22A of the foot pedal 22 from the neutral position of the rotational part 19 can be made to on (drive), and timing when the front step plate part 22A returns back to the neutral position can be made to off (stop). Accordingly, the breaker can operate only by the front step operation of the foot pedal 22.

Therefore, in a case where the breaker is equipped in the front device 4, the pedal operation switching mechanism 24 is switched to the front step limit pattern. In a case of switching the pedal operation switching mechanism 24 from the front/rear step pattern to the front step limit pattern, an operator transfers the switching operation part 32 to the rear side (operator side) by hooking the shoe bottom on the switching operation part 32 arranged in the left side to the foot pedal 22. At this time, since the rotational arm 27 is provided with the long hole 27B, the engaging member 29 can move to the front side (tip end side) against the spring member 30. As a result, the engaging member 29 can be disengaged from the front recessed groove part 26D of the positioning member 26 against an urging force of the spring member 30 to be engaged with the intermediate recessed groove part 26E positioned in the rear side. Thereby, it is possible to switch the pedal operation switching mechanism 24 to the front step limit pattern with a simple operation by his or her toe.

As shown in FIG. 9, in the front step limit pattern of the pedal operation switching mechanism 24, the restricting stay 31 abuts on an upper surface of the rear step restricting part 25C of the stay receiving member 25. Thereby, at the time of performing a rear step operation of depressing the rear step plate part 22B of the foot pedal 22, since the stay receiving member 25 abuts on the restricting stay 31, it is possible to restrict the rear step operation, that is, the stay receiving member 25 and the foot pedal 22 from rotating to the rear side.

Figure 10:
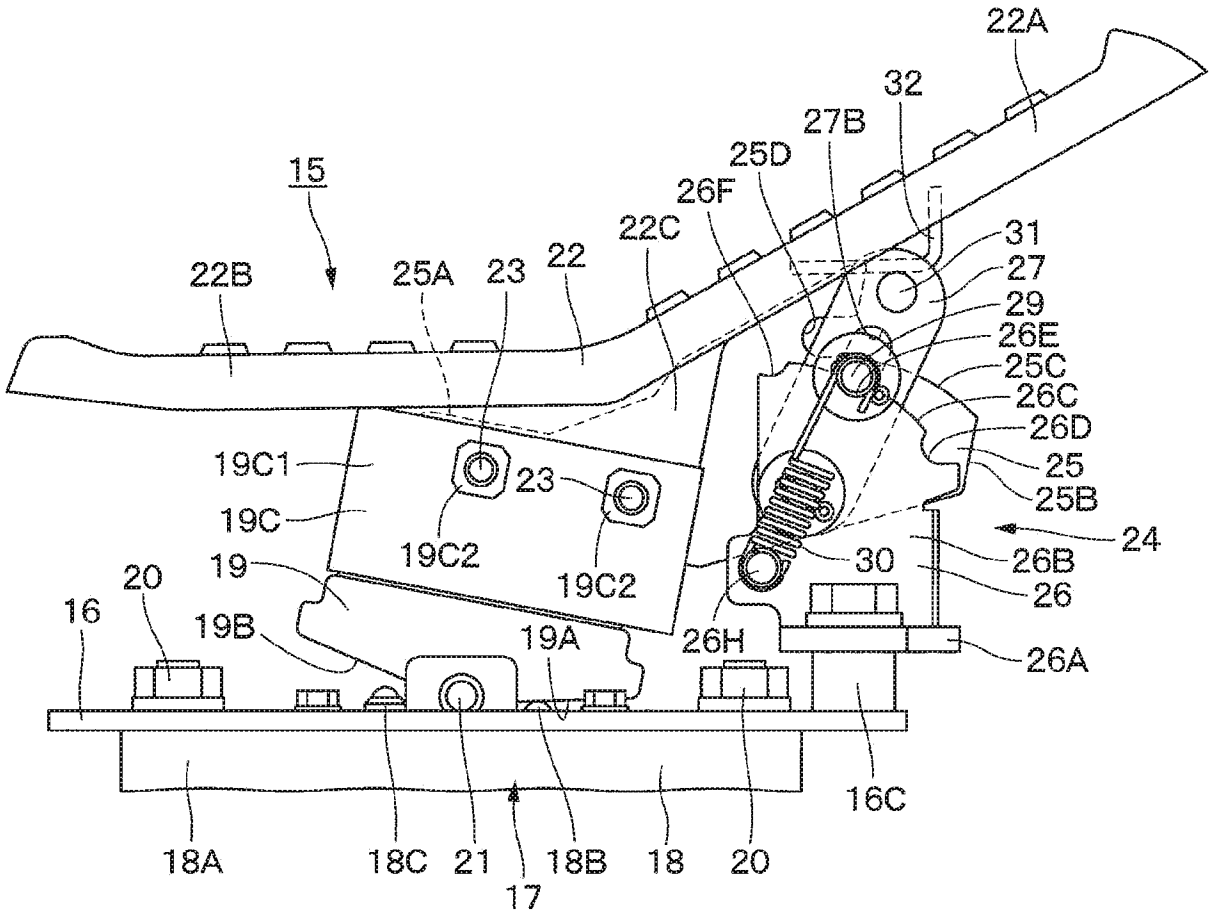
FIG. 10 is a front view showing a state of depressing the front side of the foot pedal of the additional pedal device switched to the front step limit pattern with the boot being removed.

On the other hand, as shown in FIG. 10, in the front step limit pattern of the pedal operation switching mechanism 24, it is possible to rotate downward the front side of the rotational part 19 together with the foot pedal 22 by depressing the front step plate part 22A from the neutral position of the rotational part 19 of the pilot valve 17.

Next, descriptions will be made of a case where the tool, such as the bucket 4C, not requiring the operation of the additional pedal device 15 is mounted on the front device 4. In this case, the operation of the foot pedal 22 is restricted (fixed), thus making it possible to utilize the foot pedal 22 as a footrest.

Therefore, in a case where the bucket 4C is equipped in the front device 4, the pedal operation switching mechanism 24 is switched to the fixing pattern. In a case of switching the pedal operation switching mechanism 24 from the front step limit pattern to the fixing pattern, an operator transfers the switching operation part 32 to the rear side (operator side) by hooking the shoe bottom on the switching operation part 32. Thereby, it is possible to move the engaging member 29 from the intermediate recessed groove part 26E to the rear recessed groove part 26F of the positioning member 26 against the urging force of the spring member 30 to switch the pedal operation switching mechanism 24 to the fixing pattern.

As shown in FIG. 11, in the fixing pattern of the pedal operation switching mechanism 24, the restricting stay 31 is fitted in the fixing groove part 25D of the stay receiving member 25. Thereby, at the time of performing a front step operation of the foot pedal 22, it is possible to cause the restricting stay 31 to abut on the front step abutting part 25D1 of the fixing groove part 25D from the lower side. In addition, at the time of performing a rear step operation of the foot pedal 22, it is possible to cause the restricting stay 31 to abut on the rear step abutting part 25D2 of the fixing groove part 25D from the upper side. Accordingly, the operation of the foot pedal 22 can be restricted to be fixed.

In this way, according to the present embodiment, the pedal operation switching mechanism 24 can switch the foot pedal 22 to any movement pattern of the three movement patterns of the front/rear step pattern of being capable of the operation of depressing the front side of the foot pedal 22 from the neutral position of the rotational part 19 of the pilot valve 17 and depressing the rear side of the foot pedal 22 from the neutral position of the rotational part 19, the front step limit pattern of being capable of the operation of depressing only the front side of the foot pedal 22 from the neutral position of the rotational part 19, and the fixing pattern of fixing the movement of the foot pedal 22 in the neutral position of the rotational part 19.

Accordingly, in a case where the bucket 4C is mounted on the front device 4, the pedal operation switching mechanism. 24 can switch the foot pedal 22 to the fixing pattern. In addition, in a case where the cutter or the grapple requiring the clamping (pinching) movement and the releasing (opening) movement is mounted on the front device 4, the pedal operation switching mechanism 24 can switch the foot pedal 22 to the front/rear step pattern. Further, in a case where the breaker that is driven with an on/off operation is mounted on the front device 4, the pedal operation switching mechanism 24 can switch the foot pedal 22 to the front step limit pattern.

Thereby, in a case where the breaker is mounted on the front device 4, the pedal operation switching mechanism 24 can switch the foot pedal 22 to the front step limit pattern suitable for the operation of the breaker. As a result, the pedal operation switching mechanism 24 can switch the foot pedal 22 to three kinds of the movement patterns.

The pedal operation switching mechanism. 24 is formed of the movement pattern switching section 35 and the pedal operation restricting section 36. That is, the pedal operation switching mechanism 24 is formed of the movement pattern switching section 35 that is formed of the positioning member 26, the rotational arm 27 and the engaging member 29 and performs the switching of the movement pattern in order of the front/rear step pattern, the front step limit pattern and the fixing pattern from the front side of the foot pedal 22 in the front-rear direction, and the pedal operation restricting section 36 that is formed of the stay receiving member 25 and the restricting stay 31 and restricts the rear step operation of the foot pedal 22 at the time of being switched to the front step limit pattern by the movement pattern switching section 35, and restricts the operation of the foot pedal 22 at the time of being switched to the fixing pattern by the movement pattern switching section 35.

Accordingly, the movement pattern switching section 35 can accurately perform the switching of the movement pattern in order of the front/rear step pattern, the front step limit pattern and the fixing pattern. In addition, the pedal operation restricting section 36 can restrict the rear step operation of the foot pedal 22 at the time of being switched to the front step limit pattern by the movement pattern switching section 35, and can restrict the operation of the foot pedal 22 at the time of being switched to the fixing pattern by the movement pattern switching section 35.

The pedal operation switching mechanism 24 includes a stay receiving member 25 that is provided in the rotational part 19 of the pilot valve 17 together with the foot pedal 22 to be positioned closer to the front side than the mounting shaft 28 as a rotational center of the rotational part 19 of the pilot valve 17, and is rotated integrally with the rotational part 19 and the foot pedal 22, the positioning member 26 that is provided to project upward on the base plate 16 configuring the floor member 10 in a position of facing the stay receiving member 25, and has an upper part formed as the arc-shaped part 26C with the three recessed groove parts 26D, 26E, 26F spaced in a circumferential direction on an outer peripheral side of the arc-shaped part 26C, the rotational arm 27 having a base end side that is rotatably mounted on a center side of the arc-shaped part 26C of the positioning member 26, provided with the long hole 27B in an intermediate part in a length direction and extending longer to the front side in the length direction than a position of each of the recessed groove parts 26D, 26E, 26F of the arc-shaped part 26C with a tip end side being formed as a free end, the engaging member 29 that is provided in the long hole 27B of the rotational arm 27 to be movable in the length direction of the rotational arm 27 and is selectively engaged with the three recessed groove parts 26D, 26E, 26F, and the restricting stay 31 that is provided in the tip end side of the rotational arm 27 and restricts the foot operation of the foot pedal 22 at the time of abutting on the stay receiving member 25. Accordingly, it is possible to switch the pedal operation switching mechanism 24 to the three kinds of the movement patterns by causing the engaging member 29 to be selectively engaged with the three recessed groove parts 26D, 26E, 26F.

The spring member 30 for urging the engaging member 29 toward each of the recessed groove parts 26D, 26E, 26F is provided between the positioning member 26 and the engaging member 29. In addition, the restricting stay 31 is provided with the switching operation part 32 that can switch the engaging position of the engaging member 29 to each of the recessed groove parts 26D, 26E, 26F of the positioning member 26 against the spring member 30. Accordingly, the engaging member 29 can be accurately engaged with each of the recessed groove parts 26D, 26E, 26F by the urging force of the spring member 30. On this condition, it is possible to switch the engaging position of the engaging member 29 against the spring member 30 and the movement pattern by controlling the switching operation part 32.

Further, the stay receiving member 25 is formed as a plate body extending in the front-rear direction. Moreover, the stay receiving member 25 is provided with the rear step restricting part 25C that is provided to be positioned in the front side of the plate body and on which the restricting stay 31 abuts when the pedal operation switching mechanism 24 is switched to the front step limit pattern to perform a rear step operation, and the fixing groove part 25D that is formed in the plate body to be continuous to the rear side of the rear step restricting part 25C and fixes the foot pedal 22 by the restricting stay 31 being fitted in the fixing groove part 25D when the pedal operation switching mechanism 24 is switched to the fixing pattern. Thereby, the stay receiving member 25 can cause the restricting stay 31 to smoothly move between the rear step restricting part 25C and the fixing groove part 25D.

It should be noted that the embodiment is explained by taking a case where the stay receiving member 25 is mounted on the mounting bracket 19C of the rotational part 19 in the pilot valve 17 together with the foot pedal 22, as an example. However, the present invention is not limited thereto, but may be configured of mounting the stay receiving member 25 on the foot pedal 22.

In addition, in the embodiment, the explanation is made of the switching of the movement pattern of the pedal operation switching mechanism 24 in a case of exchanging the bucket 4C of the front device 4 for the cutter, the grapple and the breaker. However, the present invention is not limited thereto, but may be configured of switching the movement pattern by the pedal operation switching mechanism 24 also in a case of the front device 4 provided with working tools other than the bucket 4C, the cutter, the grapple and the breaker.

Further, the embodiment is explained by taking the hydraulic excavator 1 of a crawler type as an example of the automotive construction machine. However, the present invention is not limited thereto, but may be applied to a wheel type hydraulic excavator, a hydraulic crane and the like, for example.

DESCRIPTION OF REFERENCE NUMERALS

1: Hydraulic excavator (Construction machine)
2: Lower traveling structure (Vehicle body)
3: Upper revolving structure (Vehicle body)
4: Front device
10: Floor member
10A: Footrest part
11: Operator's seat
15: Additional pedal device
16: Base plate (Floor member)
17: Pilot valve
18: Valve case
19: Rotational part
21: Rotational shaft (Rotational center)
22: Foot pedal
24: Pedal operation switching mechanism
25: Stay receiving member
25C: Rear step restricting part
25D: Fixing groove part
26: Positioning member
26D: Front recessed groove part
26E: Intermediate recessed groove part
26F: Rear recessed groove part
27: Rotational arm
27B: Long hole
29: Engaging member
30: Spring member
31: Restricting stay
32: Switching operation part
35: Movement pattern switching section
36: Pedal operation restricting section

The invention claimed is:

1. A construction machine comprising:

an automotive vehicle body provided with a front device at a front side in a front-rear direction;

a floor member provided in said vehicle body, said floor member having an operator's seat at a rear side and having a footrest part as a front side;

a pilot valve including a valve case provided to bore through said floor member in a position of said footrest part, and a rotational part to be rotated in an upper-lower direction in an upper side section of said valve case projecting from said footrest part;

a foot pedal that is provided in said rotational part of said pilot valve to extend in the front-rear direction and is foot-operated between a front step position in which a front side of said foot pedal is depressed from a neutral position where said rotational part of said pilot valve is in a free state and a rear step position in which a rear side of said foot pedal is depressed from the neutral position of said rotational part; and a pedal operation switching mechanism that is provided between said footrest part and said foot pedal and switches a movement pattern at the time of foot-operating said foot pedal, characterized in that:

said pedal operation switching mechanism includes:

a stay receiving member that is provided in one of said rotational part and said foot pedal to be positioned closer to the front side than a rotational center of said rotational part of said pilot valve and is rotated integrally with said rotational part and said foot pedal;

a positioning member that is projected upward from said floor member in a position of facing said stay receiving member and has an upper part formed as an arc-shaped part with three recessed groove parts spaced in a circumferential direction on an outer peripheral side of said arc-shaped part;

a rotational arm having a base end side that is rotatably mounted on a center of said arc-shaped part of said positioning member and provided with a long hole in an intermediate part in a length direction and extending longer to the front side in the length direction than a position of each of said recessed groove parts of said arc-shaped part with a tip end side being formed as a free end;

an engaging member that is provided in said long hole of said rotational arm to be movable in the length direction of said rotational arm and is selectively engaged with said three recessed groove parts; and a restricting stay that is provided in the tip end side of said rotational arm and restricts the foot operation of said foot pedal by abutting on said stay receiving member;

said pedal operation switching mechanism can switch said foot pedal to any movement pattern of three movement patterns of;

a first movement pattern of being capable of the operation of depressing the front side of said foot pedal from the neutral position of said rotational part and of being capable of the operation of depressing the rear side of said foot pedal from the neutral position, a second movement pattern of being capable of the operation of depressing only the front side of said foot pedal from the neutral position of said rotational part, and a third movement pattern of fixing the movement of said foot pedal in the neutral position of said rotational part.

2. The construction machine according to claim 1, wherein said pedal operation switching mechanism includes:

a movement pattern switching section that performs the switching of the movement patterns in order of said first movement pattern, said second movement pattern and said third movement pattern from the front side of said foot pedal in the front-rear direction; and a pedal operation restricting section that restricts the rear step operation of said foot pedal at the time of being switched to said second movement pattern by said movement pattern switching section and restricts the operation of said foot pedal at the time of being switched to said third movement pattern by said movement pattern switching section.

3. The construction machine according to claim 1, wherein said positioning member, said rotational arm and said engaging member configure said movement pattern switching section that performs the switching of the movement patterns in order of said first movement pattern, said second movement pattern and said third movement pattern from the front side of said foot pedal in the front-rear direction, and said stay receiving member and said restricting stay configure said pedal operation restricting section that restricts the rear step operation of said foot pedal at the time of being switched to said second movement pattern by said movement pattern switching section, and restricts the operation of said foot pedal at the time of being switched to said third movement pattern by said movement pattern switching section.

4. The construction machine according to claim 1, further comprising:

a spring member that is provided between said positioning member and said engaging member to urge said engaging member toward each of said recessed groove parts, wherein said restricting stay is provided with a switching operation part that can switch an engaging position of said engaging member to each of said recessed groove parts of said positioning member against said spring member.

5. The construction machine according to claim 1, wherein said stay receiving member is formed as a plate body extending in the front-rear direction, and said stay receiving member comprises:

a rear step restricting part that is provided to be positioned in the front side of said plate body and on which said restricting stay abuts when said pedal operation switching mechanism is switched to said second movement pattern and performs the rear step operation; and a fixing groove part that is formed in said plate body to be continuous to the rear side of said rear step restricting part and fixes said foot pedal by said restricting stay being fitted in said fixing groove part when said pedal operation switching mechanism is switched to said third movement pattern.

* * * * *